US006966446B1

(12) United States Patent
Wise et al.

(10) Patent No.: US 6,966,446 B1
(45) Date of Patent: Nov. 22, 2005

(54) ELONGATED PLASTIC STRIP

(75) Inventors: Thomas A. Wise, Lebanon, OH (US); William C. Wise, Pleasant Plain, OH (US)

(73) Assignee: WICO Products, Inc., Blanchester, OH (US)

( * ) Notice: Subject to any disclaimer, the term of this patent is extended or adjusted under 35 U.S.C. 154(b) by 0 days.

(21) Appl. No.: 10/655,721

(22) Filed: Sep. 5, 2003

Related U.S. Application Data

(60) Provisional application No. 60/413,119, filed on Sep. 24, 2002.

(51) Int. Cl.[7] ..... A47F 5/00
(52) U.S. Cl. ..... 211/113; 211/118; 206/806
(58) Field of Search ..... 211/59.1, 57.1, 211/73, 113; 206/806; 40/642.01, 642.02

(56) References Cited

U.S. PATENT DOCUMENTS

| | | | | | |
|---|---|---|---|---|---|
| 3,462,020 | A | * | 8/1969 | Hall | 211/26.2 |
| 4,195,739 | A | * | 4/1980 | Sweet, III | 211/113 |
| 4,483,502 | A | * | 11/1984 | Fast | 248/223.41 |
| 4,546,943 | A | | 10/1985 | Fast | |
| 4,718,627 | A | | 1/1988 | Fast et al. | |
| 4,767,012 | A | | 8/1988 | Simmons | |
| 4,911,392 | A | | 3/1990 | Fast | |
| D309,252 | S | | 7/1990 | Crowley | |
| 5,096,070 | A | * | 3/1992 | Jaynes | 211/85.15 |
| 5,183,166 | A | * | 2/1993 | Belokin et al. | 211/149 |
| 5,193,676 | A | * | 3/1993 | Gold | 206/296 |
| 5,213,220 | A | * | 5/1993 | McBride | 211/132.1 |
| 5,284,259 | A | * | 2/1994 | Conway et al. | 211/73 |
| 5,339,967 | A | | 8/1994 | Valiulis | |
| 5,366,777 | A | | 11/1994 | Bown et al. | |
| 5,386,916 | A | | 2/1995 | Valiulis | |
| 5,405,022 | A | | 4/1995 | Rissley | |
| 5,450,967 | A | * | 9/1995 | Mallory | 211/30 |
| 5,762,212 | A | | 6/1998 | Pomerantz | |
| 5,875,901 | A | * | 3/1999 | Morrow et al. | 211/59.1 |
| 5,967,341 | A | | 10/1999 | Werner | |
| 6,006,929 | A | * | 12/1999 | Leonard | 211/113 |
| 6,145,675 | A | | 11/2000 | Kass et al. | |
| 6,286,690 | B1 | | 9/2001 | Thaleyfeld | |
| 6,405,879 | B1 | * | 6/2002 | Fox | 211/50 |
| 6,637,609 | B2 | * | 10/2003 | Stevens | 211/118 |
| 2003/0150827 | A1 | | 8/2003 | Blumreich | |

* cited by examiner

*Primary Examiner*—Jennifer E. Novosad
(74) *Attorney, Agent, or Firm*—Jerrold J. Litzinger

(57) ABSTRACT

An elongated strip merchandiser for displaying merchandise from the front end of a retail store shelf. The strip contains a plurality of article retaining areas each having a cutout section which forms an upwardly extending tongue having an article-holding shelf behind the tongue, along with a locking surface opposite the tongue. A strip hanging portion is included, having an aperture where an attachment device may be fastened to suspend the strip from the edge of a store shelf.

18 Claims, 7 Drawing Sheets

ELONGATED PLASTIC STRIP

CROSS REFERENCE TO RELATED APPLICATIONS

This application claims benefit from U.S. Provisional Patent Application Ser. No. 60/413,119, filed Sep. 24, 2002, which application is incorporated herein by reference.

BACKGROUND OF THE INVENTION

1. Field of the Invention

This invention relates generally to an elongated plastic strip, and, in particular, to a strip merchandiser for displaying merchandise from the front edge of a retail store shelf.

2. Description of the Prior Art

It is a common practice for retailers to use strip merchandisers to display a variety of products from the front edge of display shelves. Usually, the strip has a series of superimposed cutout sections which form a support hook for the product. The products must be easily removable by a purchaser, while the strip must hold the products firmly in place to resist accidental dislodging by a passerby.

Many attempts have been made to improve the strip merchandiser over the years. U.S. Pat. No. 4,911,392, which issued on Mar. 27, 1990 to Fast, describes a strip merchandiser for hanging from the front edge of a display shelf having a cutout defining an upwardly pointing hook and a lower end reinforcement section. The hook and reinforcement section of the strip below the hook are folded back to reinforce the hook and increase its resistance to bending. U.S. Pat. No. 5,366,777, which issued Nov. 22, 1994 to Born et al., describes a display strip for packages of consumer products including a relatively stiff backing member and a thin detachable fascia layer disposed on the layer such that when a package is adhered to the detachable section, a consumer may remove the package and the detachable section simultaneously. U.S. Pat. No. 5,405,022, which issued Apr. 11, 1995 to Rissley, describes a display strip and hang tab combination having a first strip of flexible material and a second strip of flexible material that cooperate together to hang a product that is attachable to the second strip. U.S. Pat. No. 5,762,212, which issued to Pomerantz on Jun. 9, 1998, describes a display strip merchandiser having an item supporting section, and at least one item attachment member which is connected to the item supporting section to facilitate a secure attachment of an item on the strip. U.S. Pat. No. 6,145,675, which issued Nov. 14, 2000 to Kass et al., describes an integrally formed elongated plastic strip merchandiser having a plurality of tongues disposed along the longitudinal axis of the strip and a plurality of first shoulders protruding in a direction normal to the strip such that merchandise may be easily loaded into the strip. U.S. Pat. No. 6,286,690, which issued Sep. 11, 2001 to Thalenfill, descrbes a product display strip formed of an elongated metal strip which is suspended in vertical orientation in front of conventional product display shelving to provide a highly visible display.

SUMMARY OF THE INVENTION

It is therefore an object of the present invention to provide a strip merchandiser which locks the merchandise package onto the strip to prevent it from being accidentally dislodged by bumping the strip.

It is a further object to the present invention to provide a strip merchandiser which allows the merchandise package to be easily removed by a purchaser.

It is a still further object of the present invention to provide a strip which can be pre-loaded with products prior to shipment to the retailer without its products being dislodged during shipment.

It is a still further object of the present invention to provide a strip merchandiser which is easily loaded with merchandise packages.

It is a still further object of the present invention to provide a strip merchandiser that is suited for repeated usage.

These and other objects of the present invention will be more readily apparent from the description and drawings which follow.

DETAILED DESCRIPTION OF THE EMBODIMENTS

Figure 1:
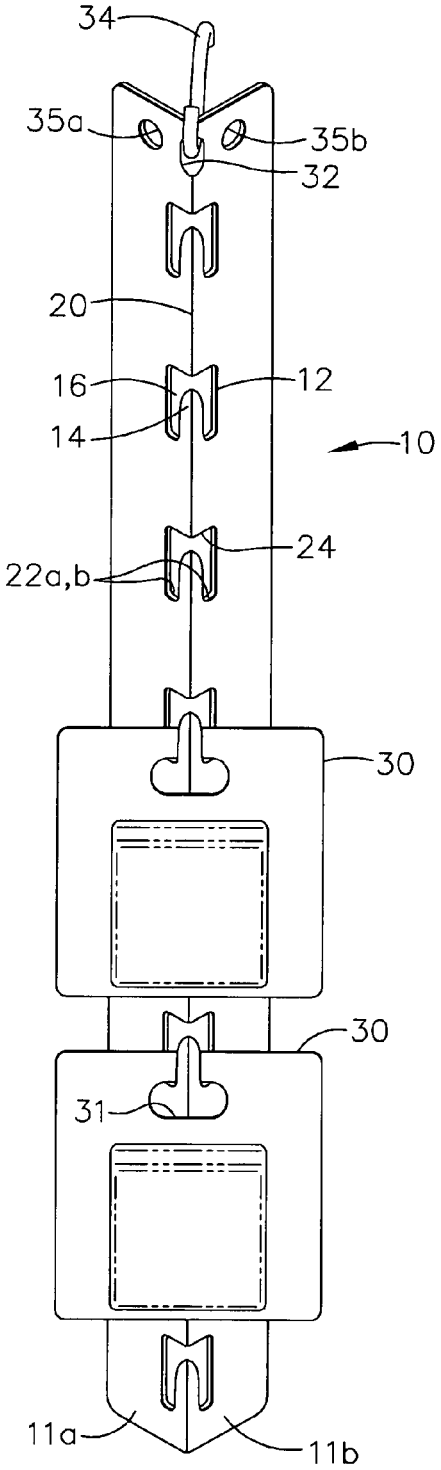
FIG. 1 is an elevational view of the plastic strip of the present invention.

Referring now to FIG. 1, there is shown a merchandiser strip, generally designated at 10, embodying the present invention. Strip 10 is formed from an integral elongated body 11 having two connected sections 11*a*, 11*b* and containing a plurality of article-retaining areas or zones 12 spaced along the length of strip 10. Each area 12 contains an upwardly extending finger or tongue 14 which extends into a cutout section 16. Strip 10 is preferably constructed from plastic such as a high density polyethylene or polypropylene. Strip 10 could also be constructed from a heavy cardboard.

Figure 4:
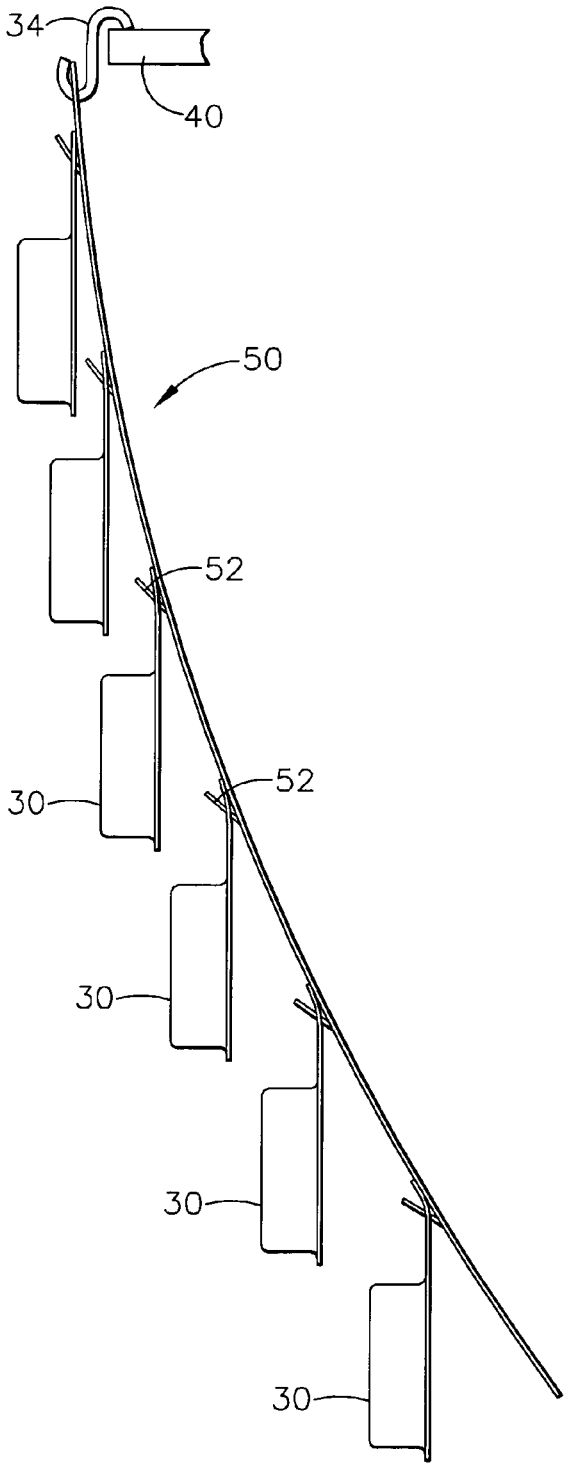
FIG. 4 is an elevational view of a prior art plastic strip in use suspended from a shelf.
Figure 5:
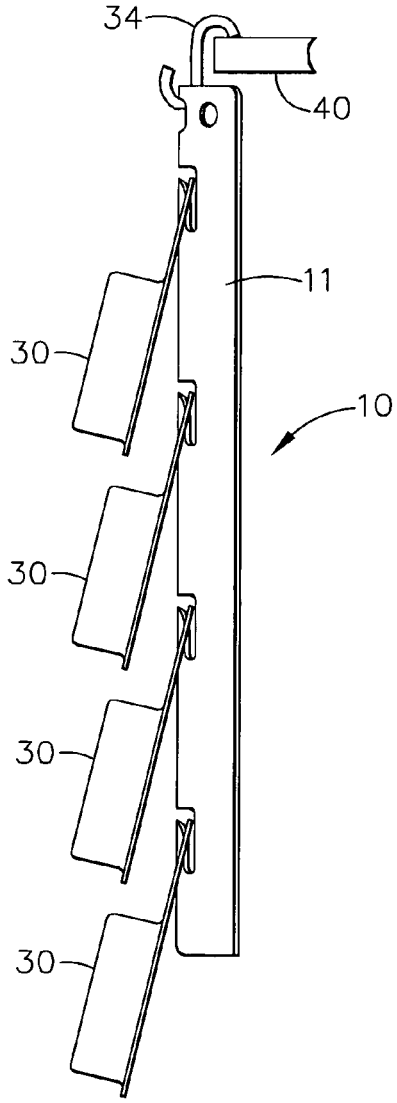
FIG. 5 is an elevational view of the plastic strip of FIG. 1 in use suspended from a shelf.

Strip 10 includes a vertical fold or crease 20 along the entire length of the strip to form sections 11*a* and 11*b*. Fold 20 passes through each article-retaining area 12 and bisects tongue 14 and cutout section 16. Folded strip 10 forms a shelf 22 and a locking surface 24 within cutout section 16. Fold 20 also reinforces strip 10 by giving the strip extra rigidity, making strip 10 less prone to reverse bending than a flat strip when the strip is loaded with a full load of objects such as blister packaged products 30 having an opening 31 through which tongue 14 is inserted. Strip 10 may also include an aperture 32 near its upper horizontal surface whereby an attachment means, such as S-hook 34, may be inserted through the aperture to hang strip 10 from a surface such as a shelf 40 (FIGS. 4 and 5). An additional pair of apertures 35*a* and 35*b* may be located on either side of aperture 32 to hold an informational tag, as will be explained later.

Figure 2:
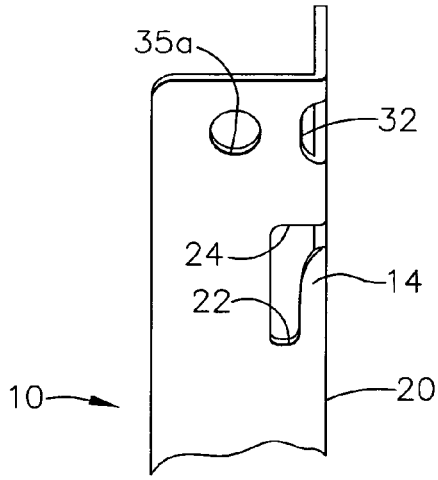
FIG. 2 is a fragmentary perspective view of the strip of FIG. 1.
Figure 3:
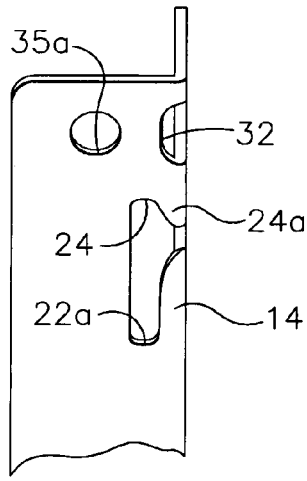
FIG. 3 is a fragmentary perspective view of an alternative embodiment of the plastic strip of the present invention.

Referring now to FIGS. 2 and 3, shelf 22 and locking surface 24 of cutout section 16 can be best seen. Shelf 22, which is formed on either side behind tongue 14 by fold 20 of strip 10, preferably includes flat surfaces 22*a*, 22*b* upon which a packaged product 30 rests when tongue 14 is inserted through opening 31 in the package. Locking surface 24 acts to limit the upward travel of packaged product 30 in the event that the product is accidentally pushed upward or sideways, with tongue 14 keeping packaged product 30 from inadvertently releasing from strip 10. Locking surface 24 may also include a downwardly depending section or extension 24*a* to further assist in keeping product 30 in position within cutout section 16.

FIG. 4 shows a prior art merchandiser strip loaded with products hanging from a shelf. Referring now to FIG. 4, strip 50, which is of the type shown in detail in FIG. 8, holds a plurality of packaged products 30 in position hanging from a display shelf 40. Strip 50 is attached to shelf 40 by means of S-hook 34, as is well known in the art. When strip 50 is loaded with packaged products 30, the strip tends to bend backward underneath shelf 40, as the planar strip is prone to reverse bending when loaded with packaged products 30 attached at its article retaining areas 52.

When strip 10 of the present invention is used to hold packaged products 30 in place on S-hook 34 off of shelf 40, the rigidity of strip 10, which is due to the fold 20 down the centerline of body 11, causes the strip to hang vertically from shelf 40, as can be seen in FIG. 5. Fold 20, which is present along the length of elongated body 11 of strip 10, reinforces the strip to resist the tendency to bend in the reverse direction when loaded with packaged products 30.

Figure 8:
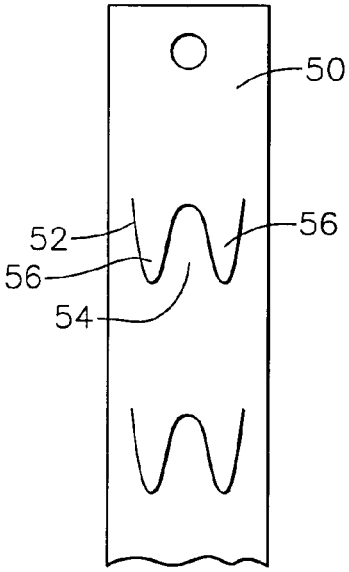
FIG. 8 (PRIOR ART)
FIG. 8 is a partial elevational view of a prior art plastic strip.

FIGS. 8–12 show some of the deficiencies present in the prior art merchandiser strip typically used in the marketplace. Referring now to FIG. 8, strip 50 includes a W-shaped cutout 52 which forms an upwardly extending tongue or hook 54 located between a pair of downwardly depending flaps 56. In practice, it has been found that positioning a packaged product 30 upon tongue 54 against flaps 56 (FIGS. 11 and 12) is inadequate, as tongue 54 is generally too weak to properly support products 30, and thus products 30 are prone to detaching from strip 50 during shipment or at the final display site.

Figure 9:
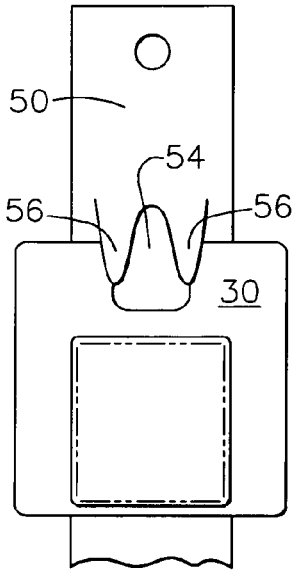
FIG. 9 (PRIOR ART)
FIG. 9 is a partial elevational view of the strip of FIG. 8 showing a product held in place.
Figure 10:
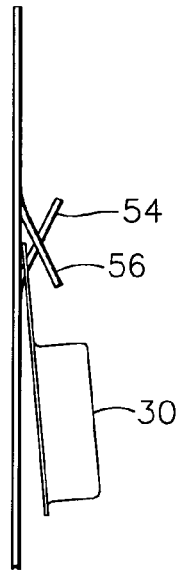
FIG. 10 (PRIOR ART)
FIG. 10 is a side view of the strip and product shown FIG. 9.

In an effort to minimize this problem, flaps 56 of strip 50 can be placed over packaged product 30 in an attempt to stabilize the connection, as can be seen in FIGS. 9 and 10. However, it is believed that more often than not, packaged products 30 are improperly loaded onto strip 50, leaving flaps 56 behind packaged product 30, as shown in FIG. 11, rather than in front as shown in FIG. 9, where flaps 56 tend to hold packaged product 30 in place.

Figure 11:
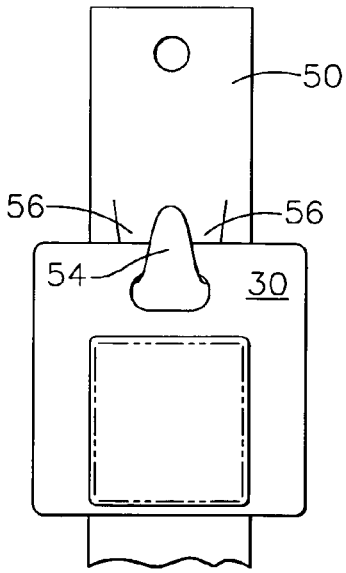
FIG. 11 (PRIOR ART)
FIG. 11 is a partial elevational view of the strip of FIG. 8 showing a product held in place in a different orientation.
Figure 12:
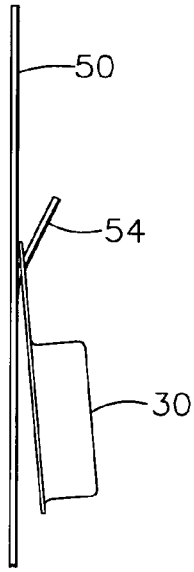
FIG. 12 (PRIOR ART)
FIG. 12 is a side view of the strip of FIG. 11.

When packaged product 30 is placed on strip 50 in the manner shown in FIGS. 11 and 12, the product pushes forward on tongue 54. If packaged product 30 weighs too much, tongue 54 bends under the forward pressure, and product 30 falls off of strip 50 or is left vulnerable to being knocked off by a passerby. It is believed that products 30 are loaded onto strip 50 in this manner because either the person loading the strip does not understand how to correctly load it, or because loading the strip in the correct manner is to difficult and thus it is easier to load the strip in the improper manner. The present invention, which is easier to load and holds the packaged products more securely on the strip while the products can still be easily removed from the strip, overcomes the disadvantages of this prior art strip.

Figure 13:
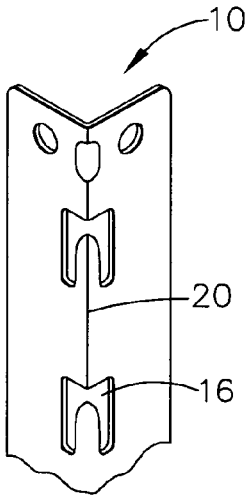
FIG. 13 is a partial elevational view of the strip shown in FIG. 1.
Figure 14:
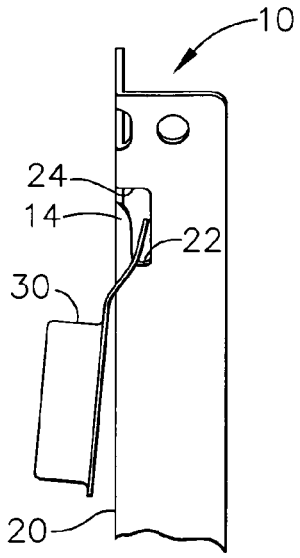
FIG. 14 is a partial side view of the strip shown in FIG. 13 holding a package.
Figure 15:
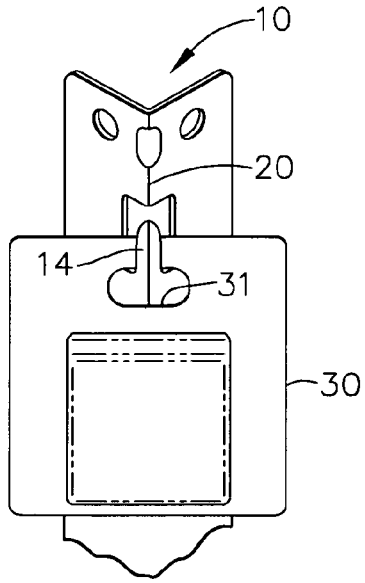
FIG. 15 is a partial elevational view of the strip of FIG. 14.

FIGS. 13–16 display the advantages of the merchandiser strip of the present invention in greater detail. Referring now to FIGS. 13–15, the shape of cutout 16 in strip 10 in combination with vertical fold 20 forms shelf 22, locking surface 24 and tongue 14, which operate to hold packaged product 30 securely in place on the strip. Centerline fold 20 also serves to reinforce tongue 14. This design does a very effective job of locking packaged product 30 onto strip 10, thus preventing the product from becoming accidentally dislodged by an incidental bump by a passerby.

While strip 10 holds packaged product 30 securely in place, removal of the product is easily accomplished when it is intended to do so. To remove packaged product 30 from strip 10, the customer merely bends the upper edge of the blister package forward slightly while pulling upward, and packaged product 30 slips off of tongue 14 without difficulty.

Figure 16:
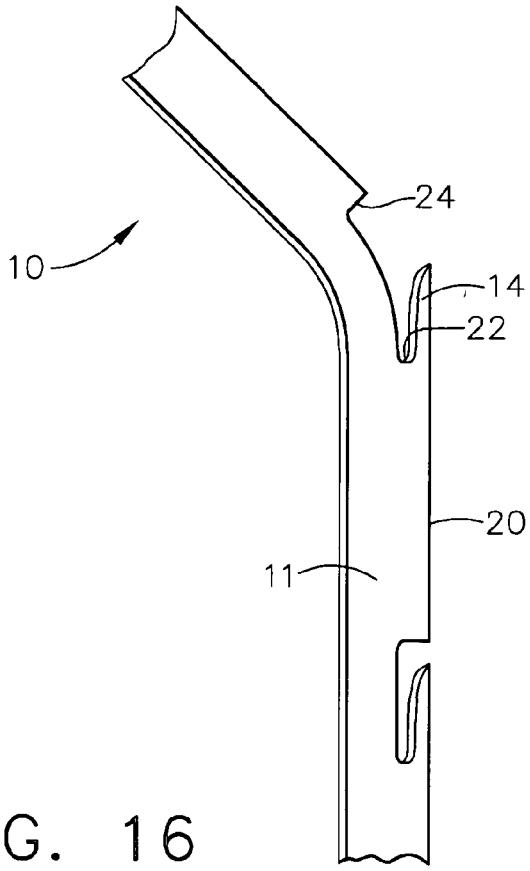
FIG. 16 is a partial side view of the strip of FIG. 1 bent slightly backward.

The design of strip 10 also allows easy and convenient loading of packaged products 30. To load strip 10, one simply bends strip 10 backward slightly behind tongue 14 as can be seen in FIG. 16, thus exposing the tongue and making it easy to slip opening 31 of packages product 30 over tongue 14. Once pressure is released, strip 10 returns to its original shape, and product 30 is locked onto the strip. Because product 30 is locked securely in place on strip 10, it is not easily dislodged in shipment. Thus, if a manufacturer wishes to preload packaged products 30 on strip 10 prior to shipment to the retailer, there is little risk of dislodging during shipment.

In addition, as packaged product 30 rests on shelf 22 behind tongue 14, rather than bending tongue 54 forward on prior art strips, as shown in FIGS. 4, 10 and 12, strip 10 holds up better to repeated use, as less stress is encountered on the holding mechanism. Therefore, strip 10 is more capable of carrying a much heavier load and is more suitable than prior art strip 50.

Figure 17:
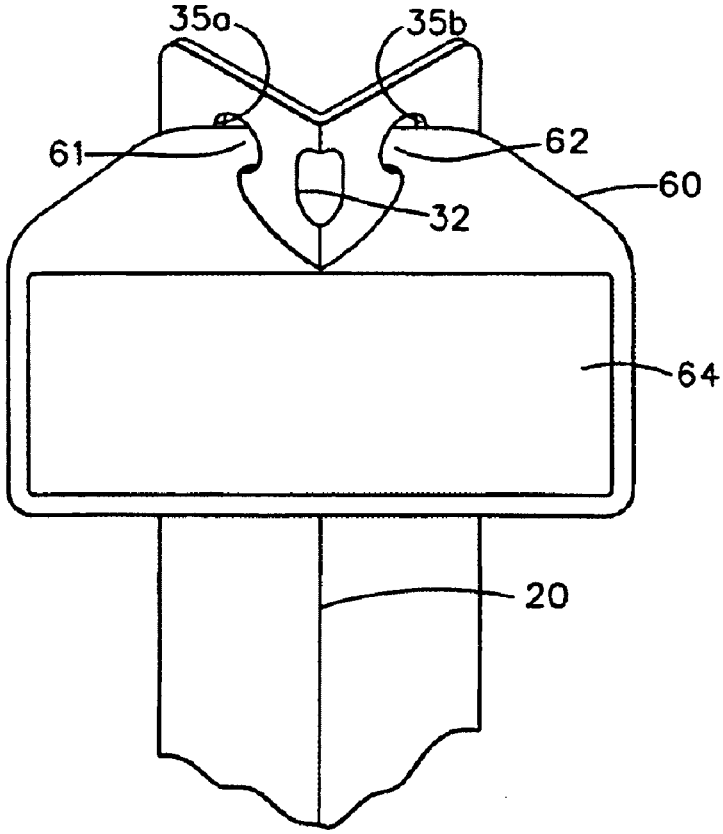
FIG. 17 is a partial elevational view of the strip shown in FIG. 1 with an optional informational tag in place.
Figure 18:
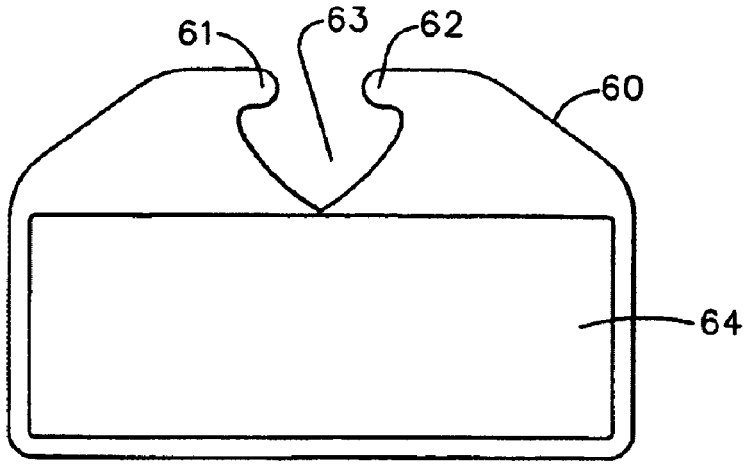
FIG. 18 is an elevational view of the tag of FIG. 17.
Figure 19:
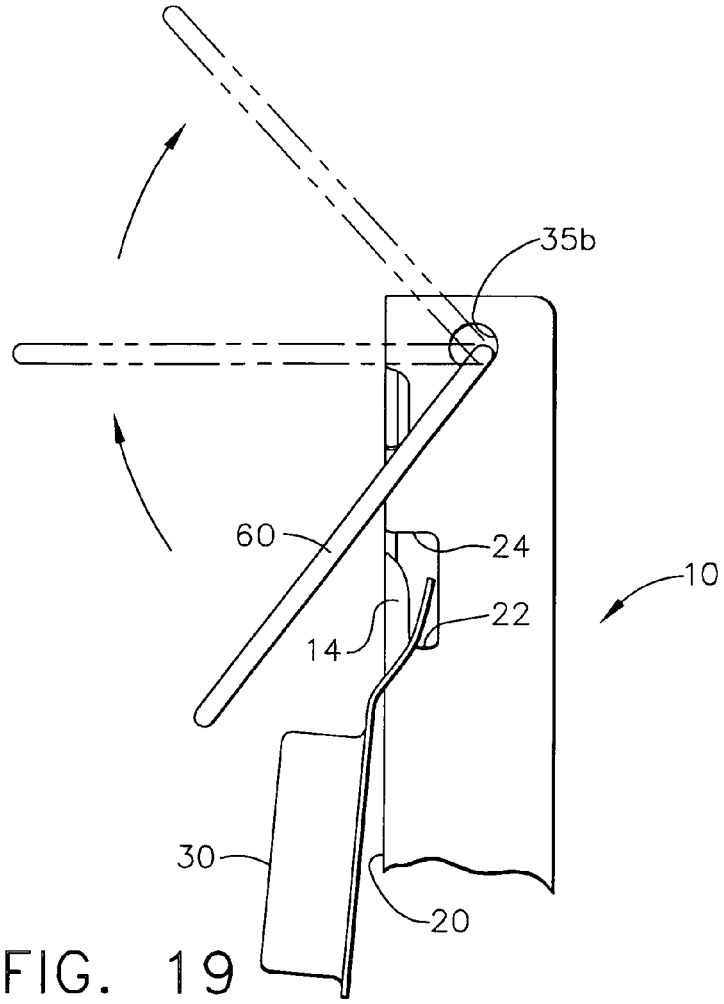
FIG. 19 is a partial side view of the strip shown in FIG. 17.

It is also very simple to add an informational tag to the strip of the present invention, as can be seen in FIG. 17. An optional banner 60 having tabs 61 and 62 simply snaps into apertures 35*a* and 35*b* of strip 10. Cutout section 63 (FIG. 18) allows banner 60 to nest neatly in front of strip 10. An adhesive backed label 64 is attached to the front of banner 60 containing common useful information such as product pricing, item numbers or SKU's, advertising, logos, etc. Banner 60 is also designed to flip up out of the way as is shown in FIG. 19 to allow the consumer easy access to the top packaged product 30.

Figure 6:
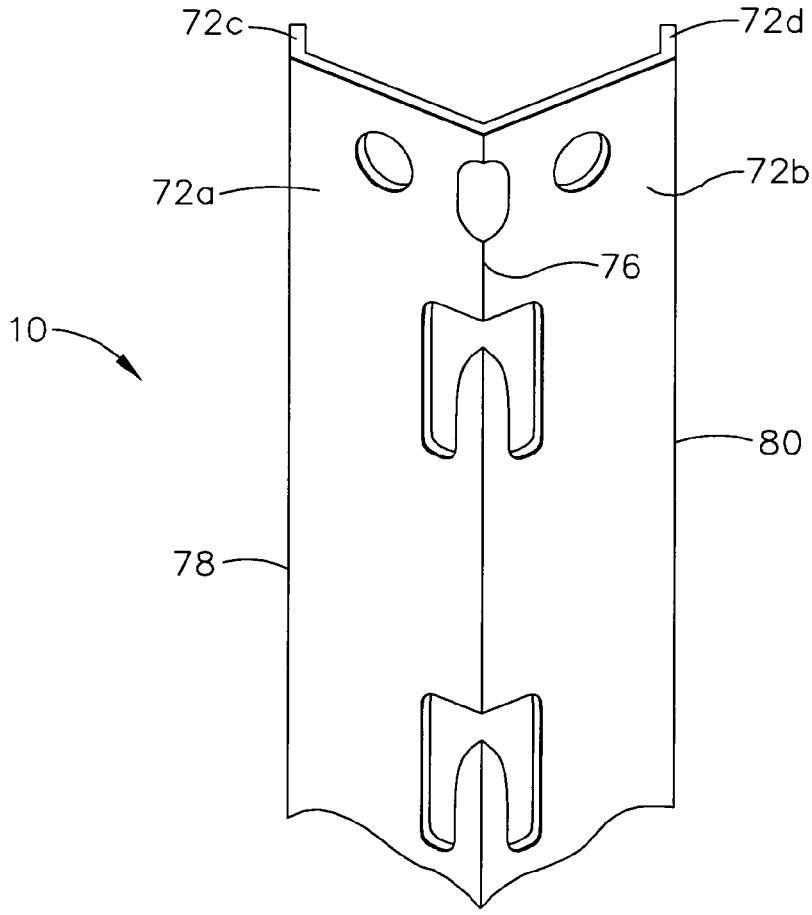
FIG. 6 is a fragmentary perspective view of an alternative embodiment of the plastic strip of the present invention.
Figure 7:
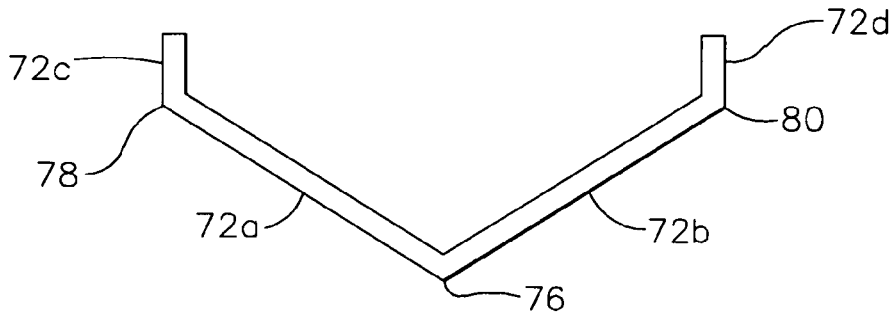
FIG. 7 is a top view of the plastic strip of FIG. 6.

FIGS. 6 and 7 show an alternative embodiment of the merchandise strip of the present invention. Referring now to FIG. 6, strip 70 includes an elongated plastic body 72 which is divided into four sections 72*a*, 72*b*, 72*c*, 72*d* by three folds

76, 78, 80. Fold 76 vertically bisects strip 70, while folds 78 and 80 form end sections 72*c* and 72*d* of strip 70. This design of strip 70 adds strength and rigidity to the device which further enhances its resistance to reverse bending when the strip is hung from the front edge of a retail shelf with a full load of heavy products.

Figure 20:
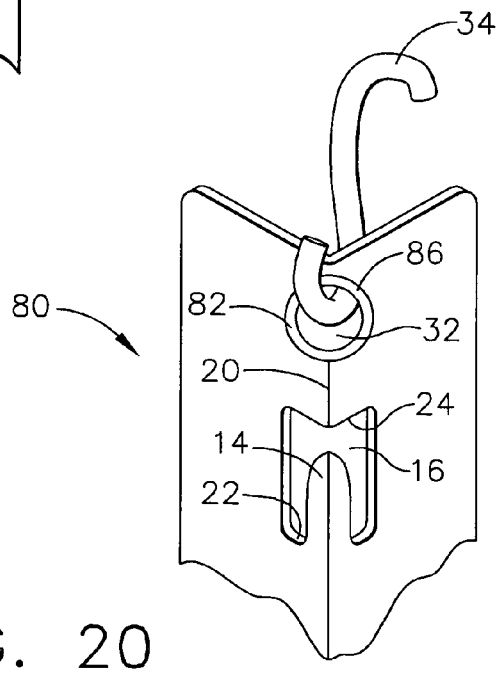
FIG. 20 is a partial elevational view of an alternative embodiment of the present invention with a reinforcing metal grommet installed.

FIG. 20 shows an alternative embodiment of the merchandise strip of the present invention. Referring now to FIG. 20, strip 80 includes a metal grommet 82 near its upper horizontal surface whereby an attachment means such as S-hook 34 may be inserted to hang strip 80 from a surface such as a shelf 40 (FIGS. 4 and 5). Metal grommet 82 provides reinforcing strength for aperture 32 at the critical attachment point 86 where the combined weight of all packaged products 30 hang. Reinforcing metal grommet 82 allows a very heavy load to be hung on strip 80 without hook 34 damaging aperture 32, leaving an unsightly stretched out hole or, worse yet, pulling through completely leaving strip 80 to fall to the floor.

As used herein and in the claims, such words as "distal", and "proximal", "top", "bottom", "behind", and the like are used in conjunction with the drawings for purpose of clarity.

While the present invention has been shown and described in terms of several preferred embodiments thereof, it will be understood that this invention is not limited to any particular embodiment and that changes and modifications may be made without departing from the true spirit and scope of the invention as defined in the appended claims.

What is claimed is:

1. A device for displaying merchandise, comprising a flexible elongated strip having a proximal end, a distal end, and a merchandise carrying portion located between said proximal end and said distal end, said merchandise carrying portion containing a vertical crease separating said merchandise carrying portion into a pair of sections, and said merchandise carrying portion having at least one article retaining zone comprising a cutout area forming a tongue and a shelf located behind said tongue for supporting an article, wherein said cutout area also forms a locking surface opposite said tongue which acts to limit the movement of said article.

2. The device of claim 1, wherein said strip is manufactured from plastic.

3. The device of claim 2, wherein said plastic comprises a high density polyethylene.

4. The device of claim 1, further comprising a strip hanging portion located between said proximal end and said merchandise carrying portion.

5. The device of claim 4, wherein said strip hanging portion contains an aperture.

6. The device of claim 5, wherein said aperture contains a grommet.

7. The device of claim 5, further including a pair of openings, with a first opening located to one side of said aperture and a second opening located to the other side of said aperture.

8. The device of claim 7, further including an information tag having a pair of tabs which fit into said first and second openings to attach said tag to said strip at said strip hanging portion.

9. The device of claim 1, wherein said locking surface includes an extension located opposite said tongue.

10. The device of claim 1, wherein said merchandise carrying portion contains three vertical creases separating said merchandise carrying portion into four sections.

11. A merchandise display strip, comprising:

a flexible elongated strip having a proximal end, a distal end, a merchandise carrying portion located between said proximal and said distal ends, and a strip hanging portion located between said proximal end and said merchandise carrying portion;

said merchandise carrying portion containing a crease running from said distal end through said merchandise carrying portion separating said merchandise carrying portion into two connected sections, and having a plurality of article retaining zones each comprising a cutout area forming a tongue and a shelf located behind said tongue for supporting an article of merchandise;

and said strip hanging portion containing an aperture for suspending said strip for display, wherein said cutout area also forms a locking surface opposite said tongue which acts to limit the travel of said article of merchandise.

12. The strip of claim 11, wherein said strip is manufactured from plastic.

13. The strip of claim 12, wherein said plastic comprises a high density polyethylene.

14. The strip of claim 11, wherein said aperture contains a grommet.

15. The strip of claim 11, wherein said locking surface includes an extension located opposite said tongue.

16. The strip of claim 11, wherein said strip is manufactured from a cardboard.

17. A merchandise display strip, comprising:

a flexible elongated strip having a proximal end, a distal end, and a merchandise carrying portion located between said proximal end and said distal end, said merchandise carrying portion having at least one article retaining zone comprising a cutout area forming a tongue and a shelf located behind said tongue for supporting an article of merchandise, and a vertical crease crossing over said cutout area and passing through said tongue of each article retaining zone.

18. The strip of claim 17, wherein said cutout area also forms a locking surface opposite said tongue which acts to limit the movement of the article of merchandise.

* * * * *